US008378190B2

(12) United States Patent
Overs

(10) Patent No.: US 8,378,190 B2
(45) Date of Patent: Feb. 19, 2013

(54) PIANO CONSTRUCTION

(76) Inventor: Ronald Ernest Overs, Concord West (AU)

( * ) Notice: Subject to any disclaimer, the term of this patent is extended or adjusted under 35 U.S.C. 154(b) by 0 days.

(21) Appl. No.: 13/395,055

(22) PCT Filed: Sep. 8, 2010

(86) PCT No.: PCT/AU2010/001162
§ 371 (c)(1),
(2), (4) Date: Mar. 20, 2012

(87) PCT Pub. No.: WO2011/029139
PCT Pub. Date: Mar. 17, 2011

(65) Prior Publication Data

US 2012/0174727 A1 Jul. 12, 2012

(30) Foreign Application Priority Data

Sep. 9, 2009 (AU) ..... 2009904329

(51) Int. Cl.
*G10C 3/04* (2006.01)

(52) U.S. Cl. ..... 84/184

(58) Field of Classification Search ..... 84/173, 84/174, 184, 185, 186.1, 186.2, 187–195
See application file for complete search history.

(56) References Cited

U.S. PATENT DOCUMENTS 4,510,837 A * 4/1985 Keller ..... 84/184

FOREIGN PATENT DOCUMENTS

| | | |
|---|---|---|
| DE | 3006081 A1 | 8/1981 |
| GB | 12081 | 0/1915 |
| GB | 23751 | 0/1897 |
| GB | 240180 | 11/1926 |
| GB | 320810 | 10/1929 |
| GB | 2329276 A | 3/1999 |

* cited by examiner

*Primary Examiner* — Kimberly Lockett
(74) *Attorney, Agent, or Firm* — Birch, Stewart, Kolasch & Birch, LLP

(57) ABSTRACT

A piano frame including a main plate having a first major surface for supporting piano strings and an opposite second major surface for supporting a soundboard. First, second, third and fourth elongate anchor zones are located on the first major surface for anchoring, respectively, first end (upper, tuneable end) and second end (lower, hitched end) of bass strings and first end (upper, tuneable end) and second end (lower, hitched end) of treble strings. A plurality of openings are provided in the main plate between the third anchor zone and the fourth anchor zone. A truss defined by a plurality bracing members integrally formed in the main plate extends between the third anchor zone and the fourth anchor zone. The bracing members are located wholly between a plane extending between the third and fourth anchor zones and a plane defined by the second major surface of the main plate.

31 Claims, 4 Drawing Sheets

PIANO CONSTRUCTION

The present disclosure relates generally to improvements in piano construction and, more particularly, to an improved piano frame and improved support for a piano soundboard. The improvements have been developed primarily for application to upright pianos. However, it will be appreciated that they may also be applied, for example, to grand pianos.

A number of different piano frame designs are known. For example, a Broadwood upright piano frame includes a peripheral frame member with an intermediate frame member extending diagonally between opposite sides of the peripheral frame member. Bass strings extend between upper and lower portions of the peripheral frame member and treble strings extend between the intermediate member and the upper portion of the peripheral frame member. A bass string bridge, generally made of timber, extends generally parallel to the lower portion of the peripheral frame member and is connected to the piano soundboard. The bass strings pass over the bridge and are connected thereto via bridge pins. Similarly, a treble string bridge, also generally made of timber, extends generally parallel to the intermediate frame member, between the intermediate frame member and the upper portion of the peripheral frame member, and is also connected to the piano soundboard. The treble strings pass over the treble string bridge and are connected thereto via bridge pins. No bracing is provided between the upper portion of the peripheral frame member and the intermediate member and, accordingly, the piano frame is susceptible to deformation during tuning and pitch changing, and to failure over the long term.

Many known upright pianos utilise intermediate struts between the intermediate frame member and the upper portion of the peripheral frame member to increase the resistance of the piano frame to deformation under the load of the piano strings. These intermediate struts extend parallel with the treble strings and are of such a height that the treble strings cannot extend thereover. Accordingly, the treble strings are only able to be provided between the intermediate struts, which disadvantageously affects the tone of the piano. Moreover, a deep cut-out must be provided in the treble string bridge to allow the intermediate strut to pass thereover. This cut-out also disadvantageously affects the tone of the piano.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In a first aspect, there is provided a piano frame comprising:

a main plate having a first major surface for supporting piano strings and an opposite second major surface for supporting a soundboard;

a first elongate anchor zone on the first major surface of the main plate for anchoring one end of bass strings;

a second elongate anchor zone on the first major surface of the main plate, spaced apart from the first anchor zone, for anchoring the other end of the bass strings;

a third elongate anchor zone on the first major surface of the main plate for anchoring one end of treble strings;

a fourth elongate anchor zone on the first major surface of the main plate, spaced apart from the third anchor zone, for anchoring the other end of the treble strings;

at least one opening in the main plate between the third anchor zone and the fourth anchor zone; and one or more bracing members fixedly connected to the main plate and extending between the third anchor zone and the fourth anchor zone, the one or more bracing members being located wholly between a plane defined between the third and fourth anchor zones and a plane defined by the second major surface of the main plate.

The one or more bracing members preferably define a truss. The one or more bracing members are preferably fixedly connected to the main frame by being integrally formed in the main frame.

An opening is preferably provided in the main plate for receiving a bass string bridge connected to the soundboard. An opening is preferably provided in the main plate for receiving a treble string bridge connected to the soundboard.

The third anchor zone is preferably adjacent the first major surface of the main plate. The fourth anchor zone is preferably spaced, from the first major surface of the main plate. The first anchor zone is preferably spaced further from the first major surface of the main plate than the fourth anchor zone is spaced from the first major surface of the main plate. The second anchor zone is preferably spaced further from the first major surface of the main plate than the second anchor zone is spaced from the first major surface of the main plate.

A first strut preferably extends across the main plate generally transverse to a line connecting the first anchor zone and the second anchor zone. The first strut preferably defines the fourth anchor zone. The first strut preferably does not extend through a plane extending between the first anchor zone and the second anchor zone. A second strut preferably extends between the first anchor zone and the second anchor zone. The second strut preferably extends through an area defined between the third anchor zone and the fourth anchor zone. The second strut preferably includes a cut-out or is raised relative to a plane extending between the third anchor zone and the fourth anchor zone so as not to contact the treble strings. A third strut preferably extends between the first anchor zone and the fourth anchor zone, preferably along an edge of an area defined between the third anchor zone and the fourth anchor zone. A fourth strut preferably extends between the fourth anchor zone and the second anchor zone, preferably along an edge of an area defined between the first anchor zone and the second anchor zone.

A secondary frame preferably at least partially overlays and is fixedly connected to the first major surface of the main plate, preferably by being formed as part of the main plate or by being welded or otherwise being fastened to the main plate. The second anchor zone is preferably on the secondary frame. The third anchor zone is preferably on the secondary frame. The fourth anchor zone is preferably on the secondary frame. The second strut is preferably formed in the secondary frame.

A first area defined between the first anchor zone and the second anchor zone, and a second area defined between the third anchor zone and the fourth anchor zone, preferably extend at least partially over the soundboard.

An area of the main plate overlaying a peripheral edge of the soundboard is preferably strengthened by a soundboard support flange fixedly connected to the main plate. The soundboard support flange is preferably continuous. The soundboard support flange preferably extends from the secondary frame. The peripheral edge of the soundboard is preferably curved, with the soundboard support flange being complementarily curved.

In a second aspect there is provided a piano frame comprising:

a main plate having a first major surface for supporting piano strings and an opposite second major surface for supporting a soundboard;

a first elongate anchor zone on the first major surface of the main plate for anchoring one end of bass strings;

a second elongate anchor zone on the first major surface of the main plate, spaced apart from the first anchor zone, for anchoring the other end of the bass strings;

a third elongate anchor zone on the first major surface of the main plate for anchoring one end of treble strings;

a fourth elongate anchor zone on the first major surface of the main plate, spaced apart from the third anchor zone, for anchoring the other end of the treble strings; and a curved flange fixedly connected to the main plate and shaped complementarily to a curved peripheral edge of the soundboard for strengthening an area of the main plate overlaying the curved peripheral edge of the soundboard.

At least one opening is preferably provided in the main plate between the third anchor zone and the fourth anchor zone, and one or more bracing members are preferably fixedly connected to the main plate and extend between the third anchor zone and the fourth anchor zone, the one or more bracing members being located wholly between a plane defined between the third and fourth anchor zones and a plane defined by the second major surface of the main plate. The one or more bracing members preferably define a truss.

An opening is preferably provided in the main plate for receiving a bass string bridge connected to the soundboard. An opening is preferably provided in the main plate for receiving a treble string bridge connected to the soundboard.

The third anchor zone is preferably adjacent the first major surface of the main plate. The fourth anchor zone is preferably spaced from the first major surface of the main plate. The first anchor zone is preferably spaced approximately the same distance from the first major surface of the main plate as the distance that the fourth anchor zone is spaced from the first major surface of the main plate. The second anchor zone is preferably spaced further from the first major surface of the main plate than the first anchor zone is spaced from the first major surface of the main plate.

A first strut preferably extends across the main plate generally transverse to a line connecting the first anchor zone and the second anchor zone. The first strut preferably defines the fourth anchor zone. The first strut preferably does not extend through a plane extending between the first anchor zone and the second anchor zone. A second strut preferably extends between the first anchor zone and the second anchor zone. The second strut preferably extends through an area defined between the third anchor zone and the fourth anchor zone. The second strut preferably includes a cut-out or is raised relative to a plane extending between the third anchor zone and the fourth anchor zone so as not to contact the treble strings. A third strut preferably extends between the first anchor zone and the fourth anchor zone, preferably along an edge of an area defined between the third anchor zone and the fourth anchor zone. A fourth strut preferably extends between the fourth anchor zone and the second anchor zone, preferably along an edge of an area defined between the first anchor zone and the second anchor zone.

A secondary frame preferably at least partially overlays and is fixedly connected to the first major surface of the main plate, preferably by being formed as part of the main plate or by being welding or otherwise being fastened to the main plate. The second anchor zone is preferably on the secondary frame. The third anchor zone is. preferably on the secondary frame. The fourth anchor zone is preferably on the secondary frame. The second strut is preferably formed in the secondary frame.

A first area defined between the first anchor zone and the second anchor zone, and a second area defined between the third anchor zone and the fourth anchor zone, preferably extend at least partially over the soundboard.

The soundboard support flange preferably extends from the secondary frame.

A preferred embodiment of the piano frame of the present disclosure will now be described, by way of example only, with reference to the accompanying drawings, in which.

Figure 1:
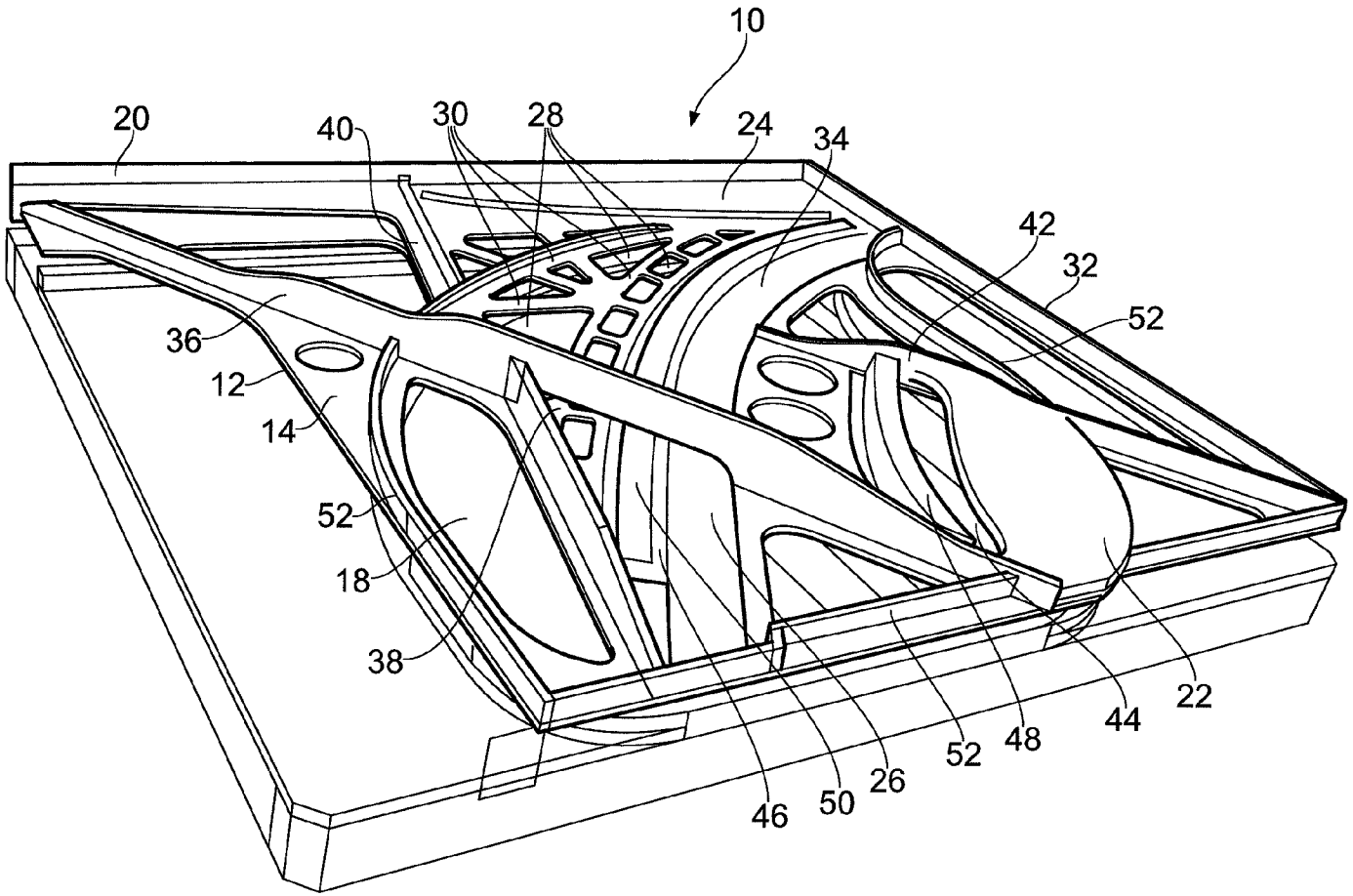
FIG. 1 is a perspective view of a preferred embodiment of a piano frame according to the present disclosure, shown without piano strings for clarity.
Figure 2:
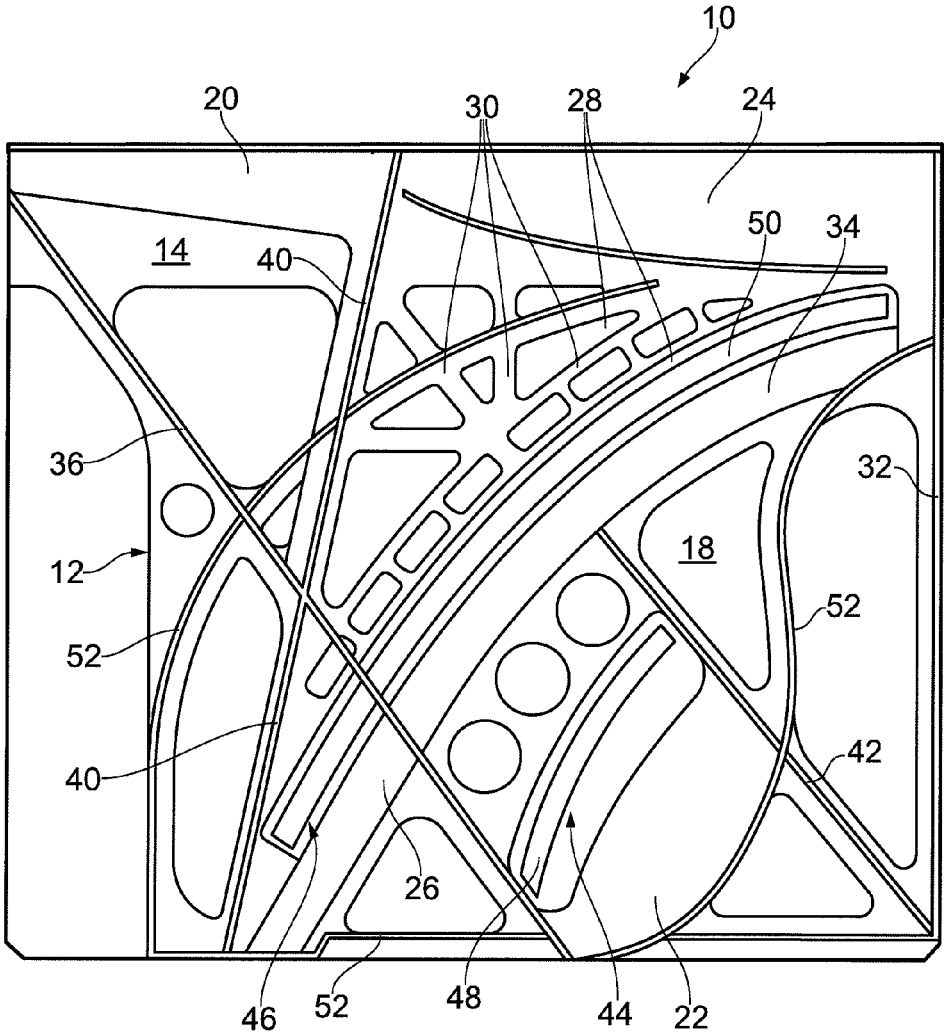
FIG. 2 is a front elevational view of the piano frame of FIG. 1, shown without piano strings for clarity and with a soundboard attached.

Referring to the drawings, there is shown a piano frame 10. The piano frame 10 comprises a main plate 12 having a first major surface 14 for supporting piano strings and an opposite second major surface 16 for supporting a soundboard 18. First 20, second 22, third 24 and fourth 26 elongate anchor zones are located on the first major surface 14 for anchoring, respectively, first end (upper, tuneable end) and second end (lower, hitched end) of bass strings and first end (upper, tuneable end) and second end (lower, hitched end) of treble strings. As best seen in FIGS. 1 and 2, a plurality of openings 28 are provided in the main plate 12 between the third anchor zone 24 and the fourth anchor zone 26. A truss defined by a plurality bracing members 30 integrally formed in the main plate extends between the third anchor zone 24 and the fourth anchor zone 26. The bracing members 30 are located wholly between a plane extending between the third 24 and fourth 26 anchor zones and a plane defined by the second major surface 16 of the main plate 12 (i.e. wholly between the treble strings and the soundboard 18).

Figure 3:
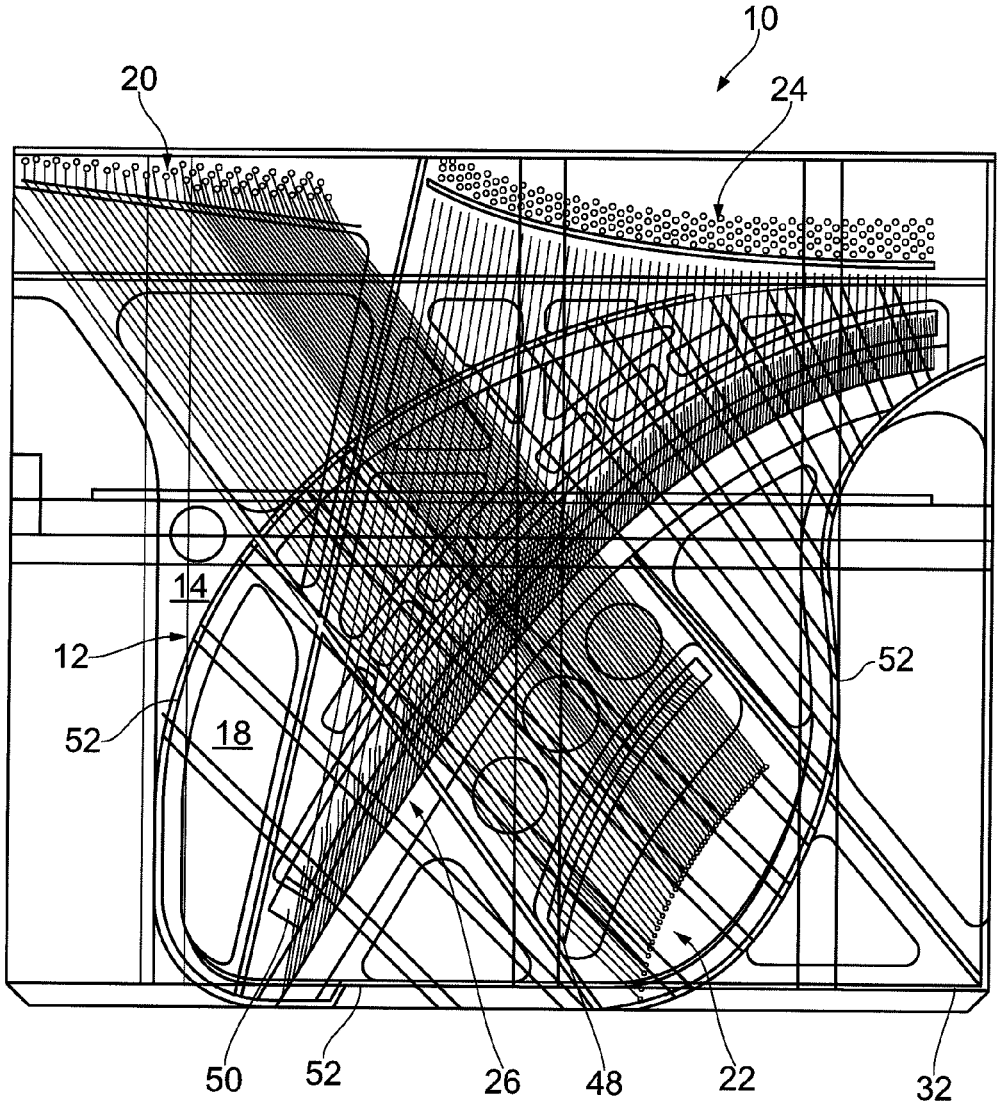
FIG. 3 is a front elevational view of the piano frame of FIG. 1, shown with piano strings.

As shown in FIGS. 1 to 3, a secondary frame 32 partially overlays and is fixedly connected to the first major surface 14 of the main plate 12. The secondary frame 32 is preferably cast in one piece as part of the main plate 12. However, in other embodiments, the secondary frame 32 is connected to the main plate 12 by welding or other fastening means. The secondary frame 32 includes a first strut 34, which extends across the main plate 12, generally transverse to a line connecting the first anchor zone 20 and the second anchor zone 22. The fourth anchor zone 26, for anchoring the lower ends of the treble strings, is defined by the first strut 34. A second strut extends 36 between the first anchor zone 20 and the second anchor zone 22, and through an area defined between the third anchor zone 24 and the fourth anchor zone 26. However, as best seen in FIG. 1, the second strut 36 includes a cut-out 38, or in alternative embodiments is raised relative to a plane extending between the third anchor zone 24 and the fourth anchor zone 26, so as not to contact the treble strings. A third strut 40 extends generally between the first anchor zone 20 and the fourth anchor zone 26, along an edge of an area defined between the third anchor zone 24 and the fourth anchor zone 26. The third strut intersects the second strut 36 at a point on the edge of the area defined between the third anchor zone 24 and the fourth anchor zone 26. A fourth strut 42 extends between the fourth anchor zone 26 and the second anchor zone 22, along an edge of an area defined between the first anchor zone 20 and the second anchor zone 22.

The third anchor zone 24, for anchoring the upper ends of the treble strings, is located on the first major surface 14 of the main plate 12. By virtue of being located on the first strut 34 of the secondary frame 32, the fourth anchor zone 26, for anchoring the lower ends of the treble strings, is spaced above the first major surface 14 of the main plate 12. The first anchor zone 20, for anchoring the upper ends of the bass strings is spaced approximately the same distance from the first major surface 14 of the main plate 12 as that of the fourth anchor zone 26 from the first major surface 14 of the main plate 12. The second anchor zone 22, for anchoring the lower ends of the bass strings, is located on a raised portion of the secondary frame 32 and is thereby spaced further from the first major surface 14 of the main plate 12 than the first anchor zone 20 is spaced from the first major surface 14 of the main plate 12.

As best seen in FIGS. 1 and 2, first 44 and second 46 openings are provided in the main plate 12 for receiving, respectively, a bass string bridge 48 and a treble string bridge 50 connected to the soundboard 18. The openings 44 and 46 are oversized relative to the respective bridges 48 and 50, such that the bridges do not contact the main plate 12 or the secondary frame 32. By virtue of the relative spacings of the first, second, third and fourth anchor zones from the main plate, and also due to the relative heights of the bridges 48 and 50, the first strut 34 does not extend through a plane extending between the first anchor zone 20 and the second anchor zone 22.

Figure 4:
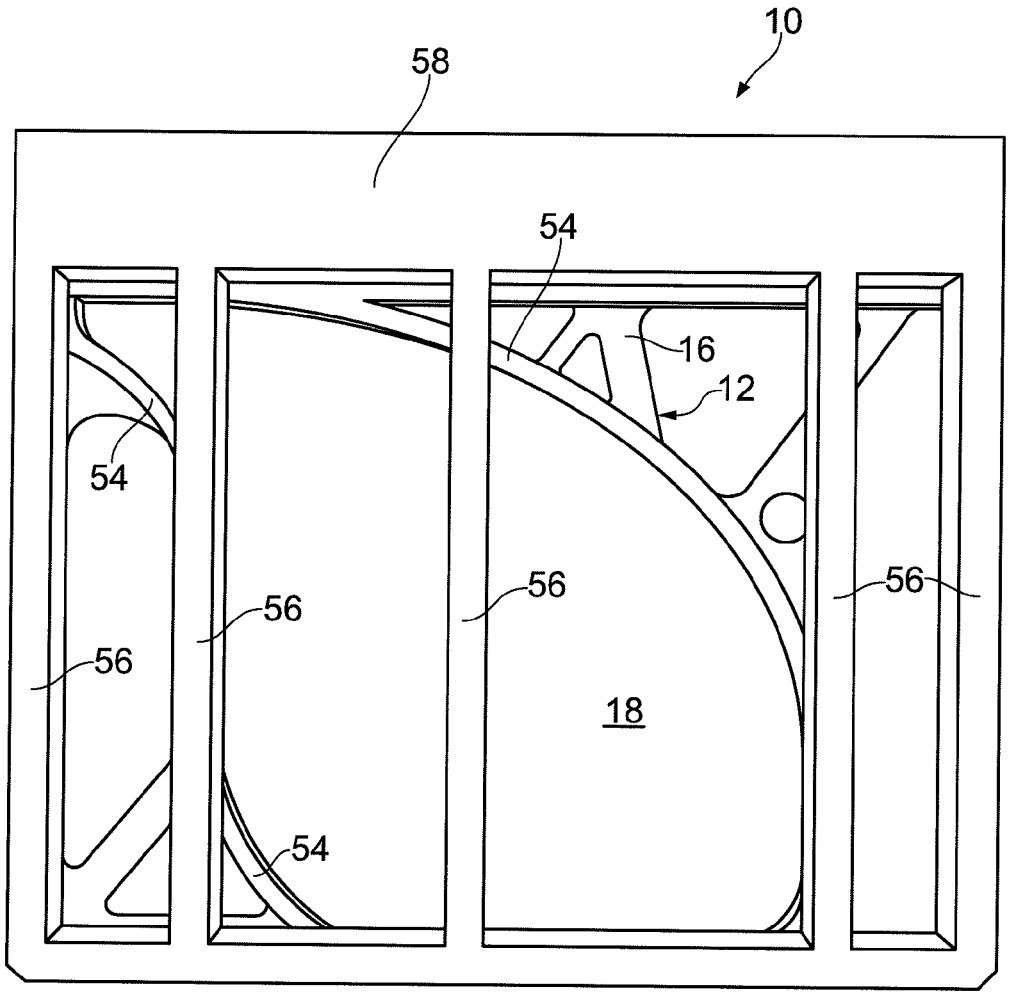
FIG. 4 is a rear elevational view of the piano frame of FIG. 1, shown without piano strings for clarity, and also showing other components in the interior of a piano cabinet.

The soundboard 18 is formed from a suitable soundboard material, such as spruce, and is generally teardrop shaped, with curved sides and a tapered end. The tapered end is located under the higher register end of the treble strings. The wider, middle portion of the soundboard 18 is located under the lower register of the treble strings and under the bass strings. As best seen in FIG. 2, an area of the main plate 12 above the peripheral edge of the soundboard 18 is strengthened by a soundboard support flange 52 of the secondary frame 32. The soundboard support flange 52 is shaped complementarily to the peripheral edge of the soundboard 18. As best seen in FIG. 4, the rear peripheral edge of the soundboard 18 is continuously supported by a perimeter flange 54 of laminated timber, which is attached to back posts 56 of the piano cabinet 58. Plywood fill panels (not shown) extend outwardly from the perimeter flange 54 to close the rear of the piano cabinet 58.

It will be appreciated that the truss defined by the bracing members 30 between the third 24 and fourth 26 anchor zones of the illustrated piano frame 10 facilitates tuning stability, whilst, due to being located between the plane of the treble strings and the soundboard 18, still allowing a uniform distribution of the treble strings to maintain tonal quality. The truss arrangement illustrated also reduces the undesirable effect of adding considerably more mass to an already relatively heavy instrument.

It will be understood by those skilled in the art that the soundboard 18 actively produces a sound pressure level through the displacement of its central area, which is in close proximity to the bridges 48, 50. The periphery of the soundboard 18 should ideally be held quite solidly still during those periods when the soundboard 18 is at its most active, to facilitate resonance. Accordingly, it will be appreciated that, with the soundboard periphery sandwiched between the main plate 12 and the laminated timber perimeter flange 54, and with the area of the main plate above the soundboard periphery strengthened by the curved soundboard support flange 52, tonal quality is improved. The added rigidity provided to the main plate 12 by the soundboard support flange 52 and the other various struts described also facilitates tuning stability and longevity, as well as the tonal quality throughout the service life of the instrument.

It will be appreciated by persons skilled in the art that numerous variations and/or modifications may be made to the specific embodiments described above without departing from the scope of the invention as broadly described. The present embodiments are, therefore, to be considered in all respects as illustrative and not restrictive. Examples of possible variations and/or modifications include, but are not limited to:

replacing the truss defined by the bracing members 30 with a continuous solid web to provide support between the third and fourth anchor zones, with or without circular or alternatively shaped cut-outs to change the appearance of the structure. Again, however, with the alternative web being located wholly between the plane extending between the third 24 and fourth 26 anchor zones and the plane defined by the second major surface 16 of the main plate 12.

The invention claimed is:

1. A piano frame comprising:

a main plate having a first major surface for supporting piano strings and an opposite second major surface for supporting a soundboard;

a first elongate anchor zone on the first major surface of the main plate for anchoring one end of bass strings;

a second elongate anchor zone on the first major surface of the main plate, spaced apart from the first anchor zone, for anchoring the other end of the bass strings;

a third elongate anchor zone on the first major surface of the main plate for anchoring one end of treble strings;

a fourth elongate anchor zone on the first major surface of the main plate, spaced apart from the third anchor zone, for anchoring the other end of the treble strings;

at least one opening in the main plate between the third anchor zone and the fourth anchor zone; and one or more bracing members fixedly connected to the main plate and extending between the third anchor zone and the fourth anchor zone, the one or more bracing members being located wholly between a plane defined between the third and fourth anchor zones and a plane defined by the second major surface of the main plate.

2. A piano frame according to claim 1, wherein the one or more bracing members define a truss.

3. A piano frame according to claim 1, wherein the one or more bracing members are fixedly connected to the main frame by being integrally formed in the main frame.

4. A piano frame according to claim 1, wherein an area of the main plate overlaying a peripheral edge of the soundboard is strengthened by a soundboard support flange fixedly connected to the main plate.

5. A piano frame according to claim 4, wherein the soundboard support flange is continuous.

6. A piano frame according to claim 4, wherein the peripheral edge of the soundboard is curved, with the soundboard support flange being complementarily curved.

7. A piano frame comprising:

a main plate having a first major surface for supporting piano strings and an opposite second major surface for supporting a soundboard;

a first elongate anchor zone on the first major surface of the main plate for anchoring one end of bass strings;

a second elongate anchor zone on the first major surface of the main plate, spaced apart from the first anchor zone, for anchoring the other end of the bass strings;

a third elongate anchor zone on the first major surface of the main plate for anchoring one end of treble strings;

a fourth elongate anchor zone on the first major surface of the main plate, spaced apart from the third anchor zone, for anchoring the other end of the treble strings; and a curved flange fixedly connected to the main plate and shaped complementarily to a curved peripheral edge of the soundboard for strengthening an area of the main plate overlaying the curved peripheral edge of the soundboard.

8. A piano frame according to claim 7, comprising at least one opening in the main plate between the third anchor zone and the fourth anchor zone, and one or more bracing members fixedly connected to the main plate and extending between the third anchor zone and the fourth anchor zone, the one or more bracing members being located wholly between a plane defined between the third and fourth anchor zones and a plane defined by the second major surface of the main plate.

9. A piano frame according to claim 8, wherein the one or more bracing members define a truss.

10. A piano frame according to claim 1, comprising an opening in the main plate for receiving a bass string bridge connected to the soundboard.

11. A piano frame according to claim 1, comprising an opening in the main plate for receiving a treble string bridge connected to the soundboard.

12. A piano frame according to claim 1, wherein the third anchor zone is adjacent the first major surface of the main plate, wherein the fourth anchor zone is spaced from the first major surface of the main plate, and wherein the second anchor zone is spaced further from the first major surface of the main plate than the second anchor zone is spaced from the first major surface of the main plate.

13. A piano frame according to claim 1, comprising a first strut extending across the main plate generally transverse to a line connecting the first anchor zone and the second anchor zone.

14. A piano frame according to claim 13, wherein the first strut defines the fourth anchor zone.

15. A piano frame according to claim 13, wherein the first strut does not extend through a plane extending between the first anchor zone and the second anchor zone.

16. A piano frame according to claim 1, comprising a second strut extending between the first anchor zone and the second anchor zone.

17. A piano frame according to claim 16, wherein the second strut extends through an area defined between the third anchor zone and the fourth anchor zone.

18. A piano frame according to claim 16, wherein the second strut includes a cut-out or is raised relative to a plane extending between the third anchor zone and the fourth anchor zone so as not to contact the treble strings.

19. A piano frame according to claim 1, comprising a third strut extending between the first anchor zone and the fourth anchor zone.

20. A piano frame according to claim 19, wherein the third strut extends along an edge of an area defined between the third anchor zone and the fourth anchor zone.

21. A piano frame according to claim 1, comprising a fourth strut extending between the fourth anchor zone and the second anchor zone.

22. A piano frame according to claim 21, wherein the fourth strut extends along an edge of an area defined between the first anchor zone and the second anchor zone.

23. A piano frame according to claim 1, wherein a first area defined between the first anchor zone and the second anchor zone, and a second area defined between the third anchor zone and the fourth anchor zone, extend at least partially over the soundboard.

24. A piano frame according to claim 7, comprising an opening in the main plate for receiving a bass string bridge connected to the soundboard.

25. A piano frame according to claim 7, comprising an opening in the main plate for receiving a treble string bridge connected to the soundboard.

26. A piano frame according to claim 7, wherein the third anchor zone is adjacent the first major surface of the main plate, wherein the fourth anchor zone is spaced from the first major surface of the main plate, and wherein the second anchor zone is spaced further from the first major surface of the main plate than the second anchor zone is spaced from the first major surface of the main plate.

27. A piano frame according to claim 7, comprising a first strut extending across the main plate generally transverse to a line connecting the first anchor zone and the second anchor zone.

28. A piano frame according to claim 7, comprising a second strut extending between the first anchor zone and the second anchor zone.

29. A piano frame according to claim 7, comprising a third strut extending between the first anchor zone and the fourth anchor zone.

30. A piano frame according to claim 7, comprising a fourth strut extending between the fourth anchor zone and the second anchor zone.

31. A piano frame according to claim 7, wherein a first area defined between the first anchor zone and the second anchor zone, and a second area defined between the third anchor zone and the fourth anchor zone, extend at least partially over the soundboard.

* * * * *